United States Patent [19]

Trechsel et al.

[11] Patent Number: 4,508,148

[45] Date of Patent: Apr. 2, 1985

[54] PHARMACEUTICAL FILLER APPARATUS

[75] Inventors: Hans W. Trechsel, Rockford; Allan B. Larson, Eden Prairie; John A. Ryerse, Maple Grove, all of Minn.

[73] Assignee: TL Systems Corporation, Minneapolis, Minn.

[21] Appl. No.: 492,222

[22] Filed: May 6, 1983

[51] Int. Cl.[3] ..... B65B 43/50

[52] U.S. Cl. ..... 141/147; 141/148; 141/95; 141/140; 251/9

[58] Field of Search ..... 141/129, 135, 138, 140–150, 141/94, 95, 392, 1; 251/4, 7, 9

[56] References Cited

U.S. PATENT DOCUMENTS

| | | | |
|---|---|---|---|
| 2,761,605 | 9/1956 | Pahl et al. | 141/147 X |
| 3,150,697 | 9/1964 | Risser | 141/140 |
| 3,219,416 | 11/1965 | Natelson | 141/129 |
| 3,575,161 | 4/1971 | London | 251/9 |
| 4,077,601 | 3/1978 | Dick | 251/9 |
| 4,136,721 | 1/1979 | Holmqvist et al. | 141/95 X |

OTHER PUBLICATIONS

Brochure of Perry Industries, Inc., Aquafil Time/Pressure Liquid Filler.

*Primary Examiner*—Stephen Marcus
*Assistant Examiner*—Ernest G. Cusick
*Attorney, Agent, or Firm*—Merchant, Gould, Smith, Edell, Welter & Schmidt

[57] ABSTRACT

A pharmaceutical filler apparatus (20) is disclosed. The pharmaceutical filler apparatus (20) cooperates with a conveyor (22) conveying containers to position each of the containers proximate a fluid delivery conduit (36) for receipt of fluid. The present invention further includes a reservoir (42) positioned above the containers at a predetermined height, the fluid being maintained in the reservoir at a constant level. The pharmaceutical apparatus (20) further includes a quick acting pinch valve (50) associated with the fluid delivery (36) for opening and closing the fluid delivery conduit (36). The pinch valve apparatus (50) includes a biasing spring (98) for biasing a valve apparatus (50) into a first position whereby the fluid delivery conduit (36) is closed. A cam actuator apparatus (54) cooperates with the pinch valve apparatus (50) to position the pinch valve (50) in a second position whereby the fluid delivery conduit (36) is opened. A timing means monitors the amount of fluid delivered into the container and activates a solenoid apparatus (62) thereby releasing the pinch valve apparatus (50) from its second position where it is releasably retained, whereby the pinch valve apparatus (50) substantially instantaneously moved into the first position to close the fluid delivery conduit (36).

18 Claims, 14 Drawing Figures

20
40
186
188
38
31
36
176
182
184
174
173
180
171
70
172
4
76
74
72
95
52
50
106
78
94
92
170
34
62
191
195
194
30
25b
25
25a
204
190
196
203
192
206
201
202
32
198
200

FIG. 7
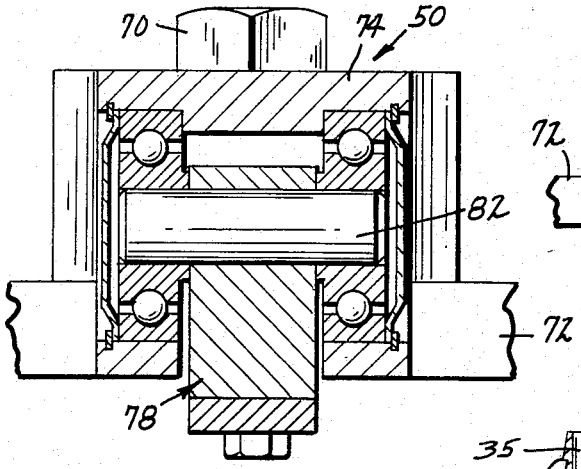
FIG. 8
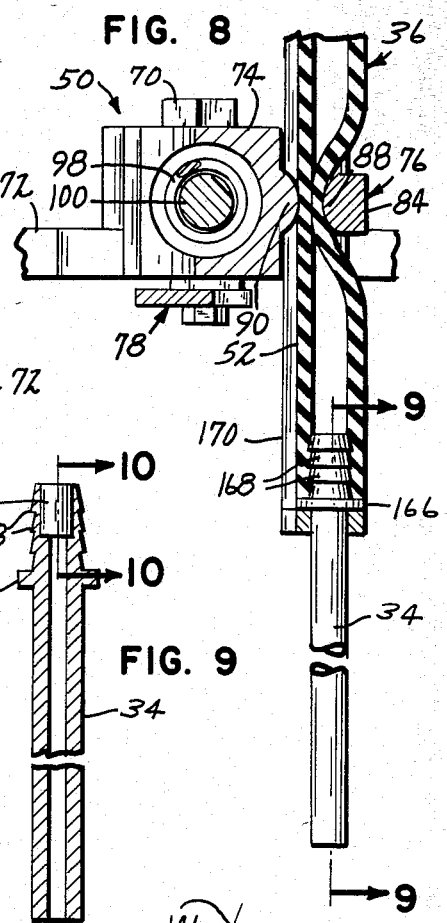
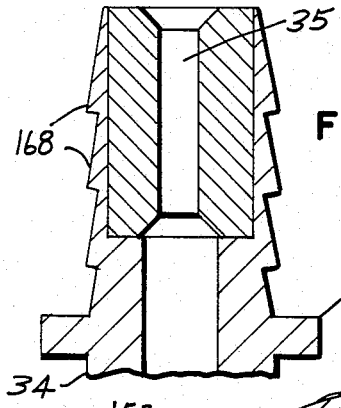
FIG. 10
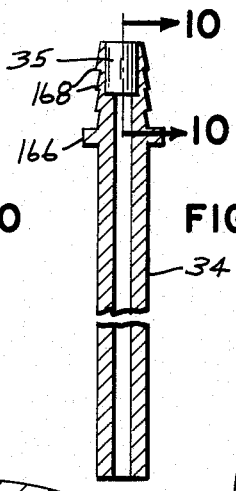
FIG. 9
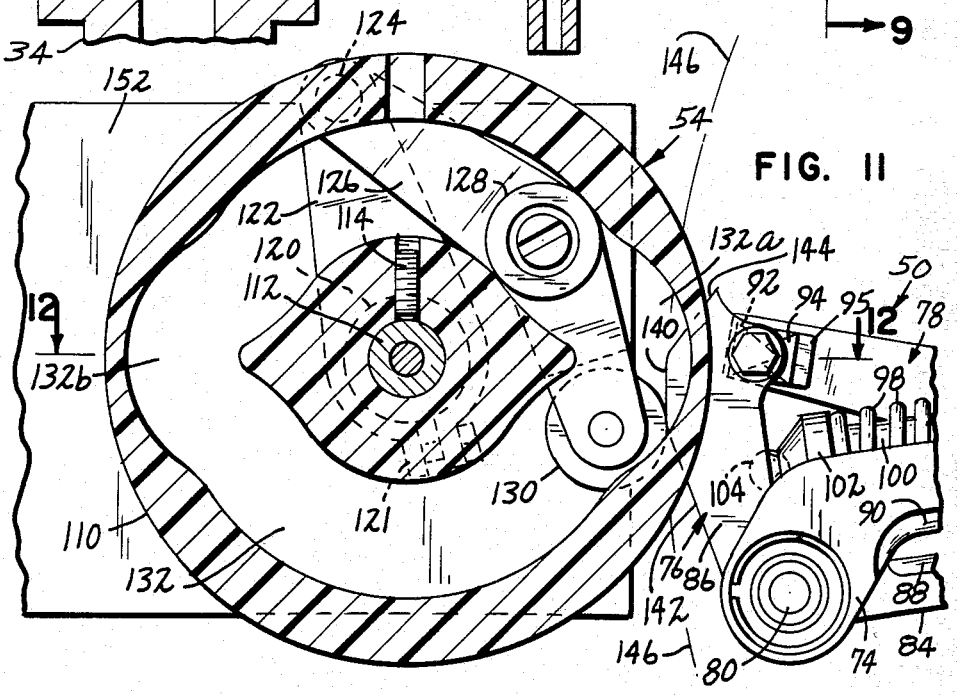
FIG. 11

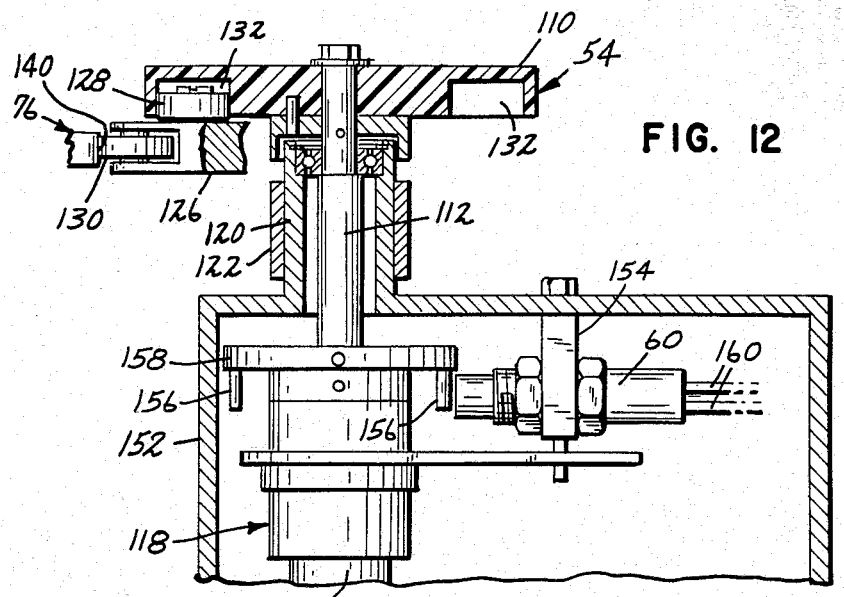
FIG. 12
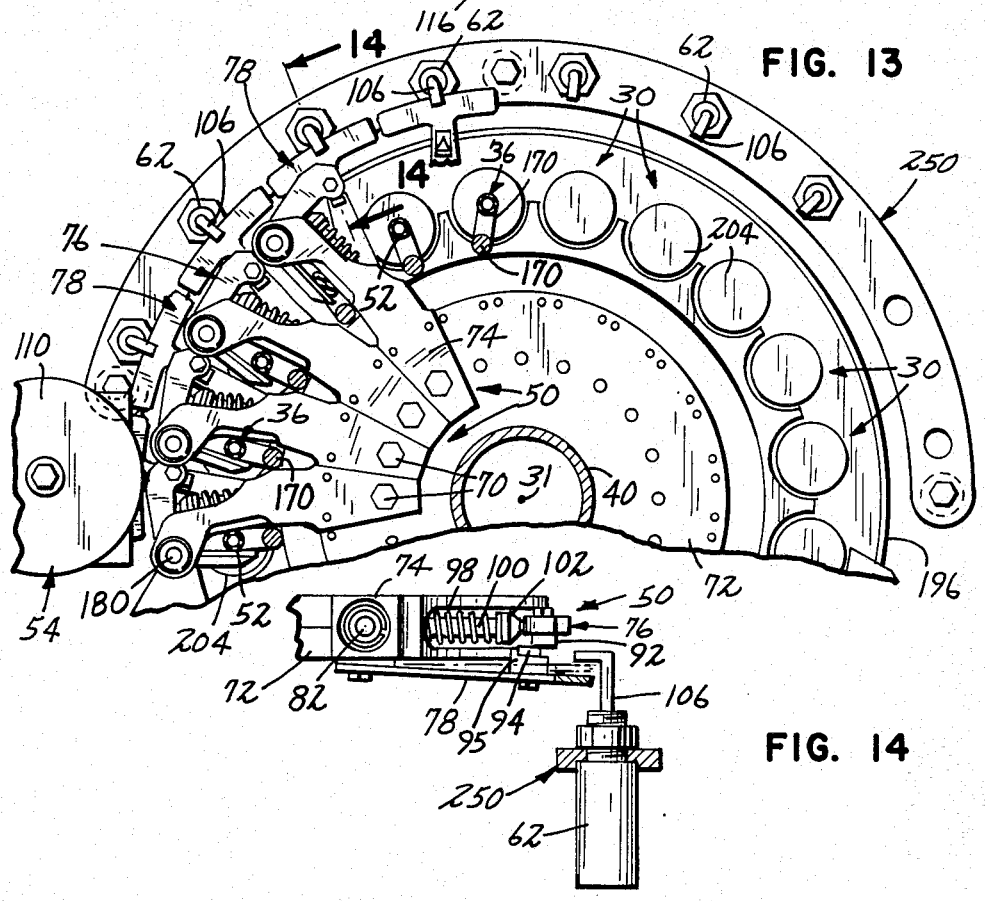
FIG. 13
FIG. 14

PHARMACEUTICAL FILLER APPARATUS

BACKGROUND OF THE INVENTION

The present invention relates to a filler apparatus. More particularly, the present invention relates to a pharmaceutical filler apparatus wherein the parameters of time, pressure, and orifice are controlled to provide for quickly, repeatedly, and accurately metering and dispensing pharmaceutical into individual containers in an assembly line environment.

Given the large demand for various pharmaceuticals and the precise quantities in which such pharmaceuticals must be packaged, there is significant demand for a pharmaceutical apparatus which will quickly, accurately, and repeatedly dispense predetermined amounts of pharmaceuticals into individual containers in an assembly line-like environment wherein the containers are rapidly conveyed one after another past the pharmaceutical filler apparatus. Furthermore, there is a need for a pharmaceutical filler apparatus which provides for a relatively clean operating environment and which is easily and readily sanitized to prevent contamination of the pharmaceuticals during the dispensing process. Additionally, in view of the high medical cost it is important that such a pharmaceutical filler apparatus be relatively inexpensive and easy to maintain and operate with a large meantime between failures.

While various filler apparatus currently available in the pharmaceutical industry were designed with various of the above requirements taken into consideration, there is much room for improvement in performance. For example, most pharmaceutical filler apparatus utilize a pump for dispensing pharmaceuticals under a predetermined pressure into the individual containers. However, pumps have several working parts and seals which are exposed to pharmaceuticals and subject to wear thereby frequently resulting in inaccuracy and contamination of the pharmaceuticals. Furthermore, pump apparatus are somewhat limited in the speed with which they can operate. In addition, pump apparatus and their associated control circuitry typically are rather costly and require substantial maintenance and installation time do to their complexity. Also, maintenance of pumps typically requires that they be disassembled which is time consuming and even more expensive.

Yet other pharmaceutical filler apparatus utilize variable position valves mounted in the pharmaceutical delivery lines, which complicates or makes impossible the dispensing of predetermine amounts of pharmaceuticals in accordance with the accuracy required in some applications. Also, as with pump systems, such valves frequently have many working parts and seals which are subject to wear thereby affecting accuracy and contaminating the pharmaceuticals by the introduction of particulate generated as a result of the wear process.

Furthermore, it is often difficult or impossible to assure repeatability of performance in pharmaceutical filler apparatus utilizing pump and/or variable valve apparatus due to the overall complexity and interaction of parts.

Some currently available pharmaceutical filler apparatus utilize an adjustable orifice in conjunction with a pinch type valve. While a pinch type valve reduces many of the problems associated with variable setting valves mounted in the pharmaceutical line, use of such a pinch type valve in conjunction with an adjustable orifice reduces accuracy and complicates control. In addition, pinch type valves are not accurate unless the pharmaceutical is delivered to the valve location at a predetermined constant pressure within the tolerance defined by the specific application.

In addition to other problems, many of these pinch valve apparatus, due to their configuration, are not sufficiently quick acting so as to provide required accuracies and/or provide fast, repetitive metering and dispensing as often required in an assembly line environment.

Furthermore, many pharmaceutical filler apparatus have reduced accuracy due to the fluid mechanics involved. In an effort to speed up the filling process, nozzles having relatively large orifices compared to the inside diameter of the pharmaceutical delivery line are utilized. Due to the properties of fluid mechanics, this frequently results in turbulent or uneven flow due to the friction between the inside walls and the pharmaceutical flowing in the delivery conduit. Furthermore, in many pharmaceutical filler apparatus the orifices are not located close to the discharge point to facilitate accurate dispensing.

In addition, many pharmaceutical filler apparatus do not readily lend themselves to sterilization as they require substantial disassembly of parts to accomplish such.

The present invention solves these and many other problems associated with the art.

SUMMARY OF THE PRESENT INVENTION

The present invention relates to a valve apparatus used in conjunction with an elastomeric portion of a fluid delivery conduit in a fluid dispensing and metering filler apparatus. The valve apparatus includes a stationary member having a first pivotal member pivotally connected thereto for pivotal movement about a substantial vertical axis, the first pivotal member being pivoted between first and second positions. The valve apparatus further includes spring biasing means interconnected to the first pivotal member for biasing the first pivotal member into the first position, the first pivotal member pinching shut the elastomeric portion of the fluid delivery conduit when in the first position. The valve apparatus further includes mechanical cam means cooperating with the first pivotal member for positioning the valve apparatus in the second position, the elastomeric portion of the fluid delivery conduit being opened when the first pivotal member is in the second position. The valve apparatus further includes retention means for releasably retaining the first pivotal member in the second position and release means for releasing the retention means. When released by the retention means, the spring biasing means forces the valve apparatus substantially instantaneously into the first position, whereby the valve apparatus effectively has two positions, either opened or closed.

The present invention further relates to a fluid dispensing and metering assembly including a conveyor for conveying containers and a first detection means for detecting movement of the containers past a first predetermined location. The assembly further includes means cooperating with the conveyor for positioning each of the containers proximate a fluid delivery conduit for receipt of fluid therefrom. A reservoir of fluid is positioned above the containers at a predetermined height, the reservoir including means for maintaining a constant fluid level in the reservoir. The fluid delivery conduit is interconnected to the reservoir to provide a fluid flow path from the reservoir to the container positioned for receipt of fluid from the fluid delivery conduit. The fluid delivery conduit includes a fixed orifice of substantially less diameter then the inside diameter of the fluid delivery conduit, the fixed orifice being positioned closer to the point of fluid discharge into the container then to the fluid reservoir. The assembly further includes quick acting pinch valve means associated with the fluid delivery conduit for opening and closing the fluid delivery conduit, the pinch valve means having first and second positions. The pinch valve means interacts with an elastic portion of the fluid delivery conduit so as to pinch shut the elastic portion when in the first position, the elastic portion being fully opened when the valve means is in the second position. The valve means further includes biasing means for biasing the valve means toward the first position and further includes releasable retention means for retaining the valve means in the second position, the valve means returning substantially instantaneously to the first position upon release by the retention means. A cam actuator is positioned downstream from the first detection means for positioning the valve means in the second position. First timing means monitors the movement of the containers after being detected by the first detection means, the first timing means activating the cam actuator means when one of the containers and its associated valve means are suitably positioned adjacent the cam actuator means. Second detection means is provided for detecting the positioning of the valve means in the second position while second timing means is provided for monitoring the amount of fluid delivered into the containers. The assembly further includes release means activated by the second timing means for releasing the retention means whereby the pinch valve apparatus moves into the first position.

One particularly advantageous feature of the present invention is the use of a two position, pinch valve which is either fully opened or fully closed and acts on a resilient portion of the pharmaceutical delivery conduit having good memory characteristics. When utilized with such a resilient portion exhibiting good memory characteristics, the pinch valve apparatus provides for quickly opening or closing the pharmaceutical delivery conduit. Accordingly, the valve apparatus has no intermediate or variable setting, but is either on or off. This enables much more accurate metering of pharmaceutical being dispensed than is possible with a variable setting valve wherein the pharmaceutical delivery conduit progresses gradually through varying degrees of opening during the opening and closing process.

Yet another advantageous feature of the present invention is the use of a fixed orifice in a nozzle portion of the pharmaceutical delivery conduit which is substantially smaller than the inside diameter of the pharmaceutical delivery conduit. This feature prevents turbulence and unpredictable liquid flow due to the friction between the flowing liquid and the inside surfaces of the pharmaceutical delivery conduit. Furthermore, in yet another embodiment of the present invention, the nozzle is readily interchangeable thereby enabling varying sizes of orifices to be used. In addition, in yet another embodiment the pharmaceutical delivery conduit and its nozzle are readily removed to facilitate sterilization of system parts.

Yet another advantageous feature of the present invention is the apparatus and method utilized for provide a constant, precise pressure. The pharmaceutical is retained in a reservoir located above the pinch valve at a predetermined height, the reservoir having a large volume compared to the volume of fluid in the pharmaceutical delivery conduits. The level of the fluid or pharmaceutical in the reservoir is monitored and upon detection of a change, control apparatus provides for the input of additional fluid to maintain the appropriate level. Due to the large volume of reservoir, the change in fluid level is gradual thereby enabling the control apparatus to easily compensate for any changes in fluid level without having to rapidly switch on and off. As a result, the reservoir and its associated level control apparatus provide for very accurate pressure and furthermore, are readily cleaned.

Yet another advantageous of the present invention is the use of an electronic timing apparatus which monitors the amount of time the pinch valve is open. Accordingly, based on the amount of time, pressure, and orifice size, pharmaceuticals can be accurately, quickly, and repeatedly delivered to the containers.

In addition, the pharmaceutical filler apparatus of the present invention lends itself to being thoroughly cleaned so as to meet the stringent cleanliness requirements in the pharmaceutical industry.

Furthermore, it will be appreciated that the present invention has application in other industries, such as the cosmetic and food industries, wherein accuracy and/or cleanliness and cleanability are required.

These and various other advantages and features of novelty which characterize the invention are pointed out with particularity in the claims next hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

FIG. 7 is a view in vertical section as seen generally along line 7—7 in FIG. 4;

FIG. 8 is a view in vertical section as seen generally along line 8—8 in FIG. 4 and further illustrating a nozzle portion attached to an elastic portion of a pharmaceutical delivery conduit;

FIG. 9 is a view in section as seen generally along line 9—9 in FIG. 8;

FIG. 10 is an enlarged sectional view of the orifice portion of the nozzle illustrated in FIG. 9;

FIG. 11 is a fragmentary horizontal sectional view of an embodiment of a cam actuator apparatus illustrating the cooperation between the cam actuator apparatus and the pinch valve apparatus illustrated in FIG. 4;

FIG. 12 is a view in vertical section as seen generally along line 12—12 in FIG. 11, and further illustrating a sensor apparatus for detecting movement of the cam actuator apparatus;

FIG. 13 is a fragmentary view similar to FIG. 2 showing of an alternate embodiment of the pharmaceutical filler apparatus of the present invention; and FIG. 14 is a sectional view as seen generally along line 14—14 in FIG. 13.

DETAILED DESCRIPTION OF THE PREFERRED EMBODIMENT

Figure 1:
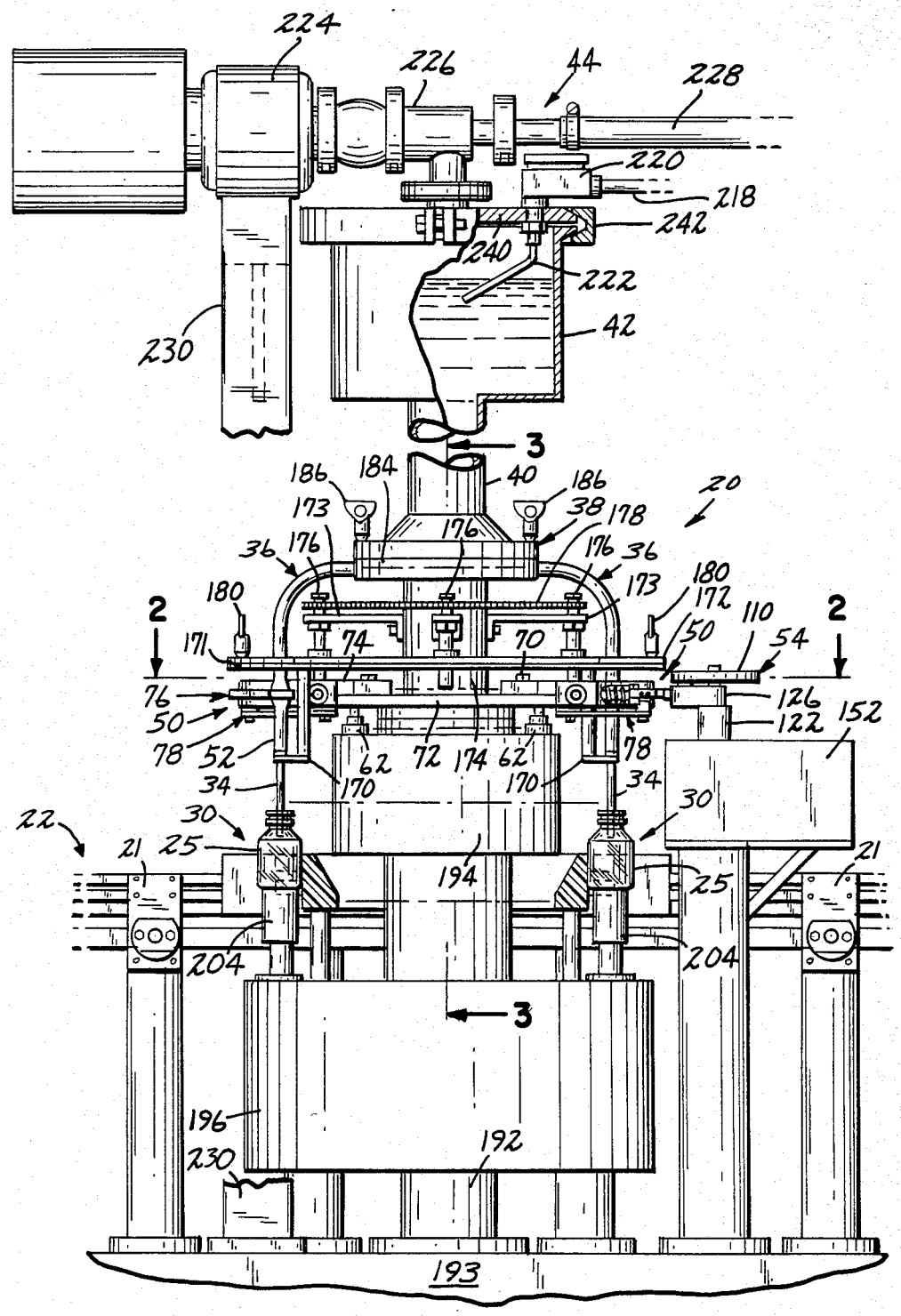
FIG. 1 is a fragmentary view in elevation with portions broken away and shown in section of a preferred embodiment of a pharmaceutical filler apparatus emboding the principles of the present invention.
Figure 2:
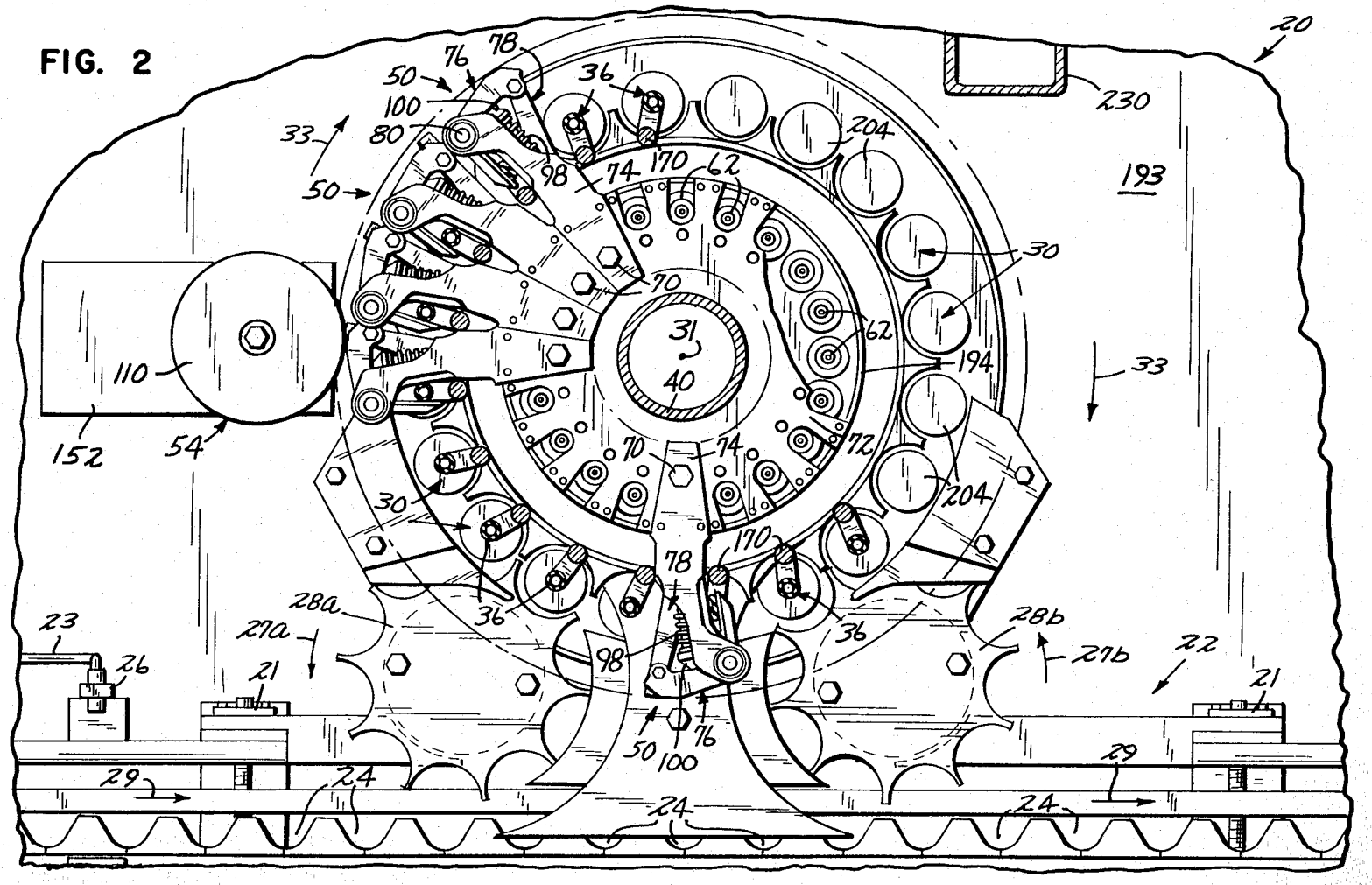
FIG. 2 is an enlarged view in horizontal section as seen generally along line 2—2 in FIG. 1, illustrating the pharmaceutical filler apparatus operatively interconnected to a conveyor line.
Figure 3:
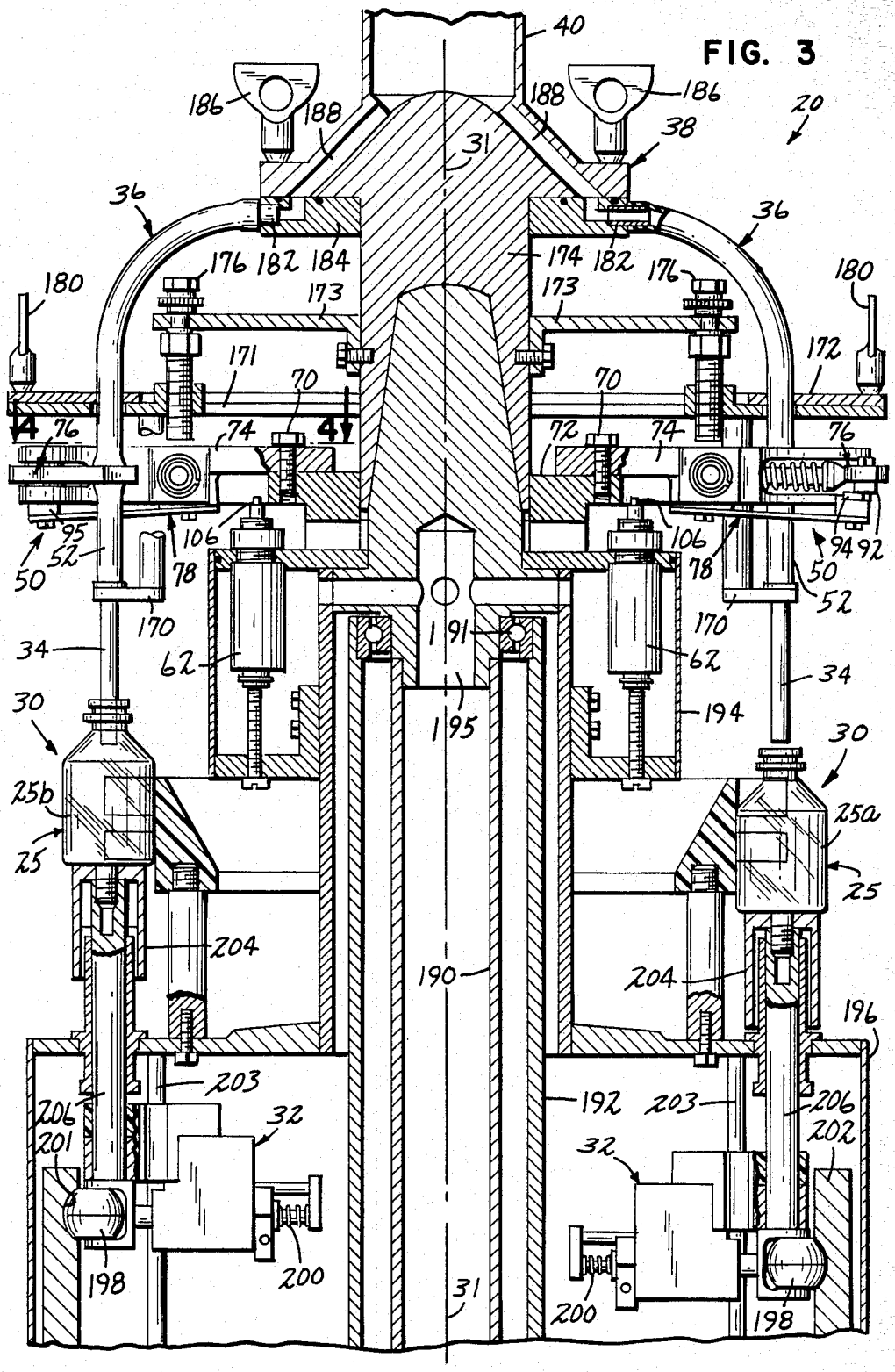
FIG. 3 is an enlarged view in vertical section as seen generally along line 3—3 in FIG. 1.

Referring now to the drawings, there is shown in FIGS. 1 through 3 a preferred embodiment of the pharmaceutical filler apparatus of the present invention, generally designated by the reference numeral 20. Various ones of multiple elements of the pharmaceutical filler apparatus 20 are not shown in these figures for sake of clarity and understanding of the invention. The pharmaceutical filler apparatus 20 is illustrated in FIG. 2 as being utilized in conjunction with a conveyor apparatus 22 including a plurality of stations 24 for conveying pharmaceutical containers. (For purposes of this specification, the pharmaceutical containers will be referred to as moving in the downstream direction as illustrated by arrows 29, the opposite direction being the upstream direction.) Typically, the conveyor 22 will include an adjustment apparatus 21 enabling the conveyor 22 to be adjusted for conveying various sizes of containers. Positioned adjacent the conveyor apparatus 22 upstream of the pharmaceutical filler apparatus 20 is a sensor 26 for sensing movement of the pharmaceutical containers as they move past the sensor 26. Typically, the sensor 26 will be of a photocell variety which is electrically connected by a suitable connector 23 to an electronic timing system (not shown). The timing system might for example be any conventional microprocessor controlled system utilizing currently available components. It will be appreciated that various timing systems might be utilized in keeping within the principles of the present invention. The embodiment of the pharmaceutical filler apparatus 20 illustrated has a rotary configuration for rotation about a substantially vertical axis 31 offset from the longitudinal axis of the conveyor apparatus 22. Arrows 33 in FIG. 2 indicate the direction of rotation. The conveyor 22 is suitably interconnected to the pharmaceutical filler apparatus 20 by rotary conveyor portions 28*a, b,* whose direction of rotation is indicated by arrows 27*a, b,* to enable the pharmaceutical containers to be conveyed from the conveyor 22 and onto stations 30 about the circumference of the pharmaceutical apparatus 20.

Once positioned on the stations 30 of the pharmaceutical filler apparatus 20, the pharmaceutical containers are raised by a lift apparatus 32 associated with each of the stations 30 such that a nozzle 34 of a pharmaceutical delivery conduit 36 associated with each of the stations 30 is positioned partially into the pharmaceutical containers when the container is in a raised position. This is illustrated in FIG. 3, wherein a container 25*a*, is in a lowered position and a container 25*b* is in a raised position. The pharmaceutical delivery conduits 36, as illustrated in FIGS. 1 and 2, are interconnected to a manifold portion 38 which in turn is connected by a single conduit 40 to a reservoir 42 holding the pharmaceutical which is being metered and dispensed by the pharmaceutical apparatus 20 into each of the individual pharmaceutical containers. The pharmaceutical level in the reservoir 42 is maintained at a constant value by a level control assembly 44 to assure that the pharmaceutical is being dispensed at a constant pressure.

As illustrated in FIGS. 1 through 3, associated with each of the pharmaceutical delivery conduits 36 is a mechanical pinch valve apparatus 50, hereafter described in more detailed. Various ones of the pinch valve apparatus 50 have been removed from FIG. 2 and only two of the pinch valve apparatus 50 are shown in FIGS. 1 and 3 for the sake of clarity and understanding. The pinch valve apparatus 50 cooperate with an elastic portion 52 of their associated pharmaceutical delivery conduit 36 to open the associated pharmaceutical delivery conduit 36 upon activation by a cam actuator 54, hereafter describe in more detailed, positioned adjacent the pharmaceutical apparatus 20. The cam actuator 54 is operatively interconnected to the electronic timing system receiving inputs from the sensor 26. Accordingly, as each of the pinch valve apparatus 50 and its associated pharmaceutical delivery conduit 36 is rotated past the cam actuator apparatus 54, the cam actuator apparatus 54 opens the pinch valve apparatus 50 such that pharmaceutical can be dispensed through the pharmaceutical delivery conduit 36 from the reservoir 42 into the associated pharmaceutical container which has been previously raised by the lift apparatus 32 so as to be in the filling position.

A sensor 60, illustrated in FIG. 12, detects when the pinch valve apparatus 50 is opened by the cam actuator apparatus 54 and provides an input signal to the microprocessor controlled electronic timing system. The timing system determines when the required amount of pharmaceutical has been delivered to the pharmaceutical container based on the parameters of the amount of time the pinch valve apparatus 50 is open, the pharmaceutical pressure in the pharmaceutical delivery conduit 36, and the size of the orifice or opening in the nozzle 34 through which the pharmaceutical passes. The electronic timing system then signals a solenoid 62, there being one solenoid associated with each of the pinch valve apparatus 50 to close its associated pinch valve apparatus 50. The pharmaceutical container is than lowered by the lift apparatus 32 and the pharmaceutical container is conveyed back onto the conveyor 22 for further processing such as capping and sealing.

More particularly, as illustrated in FIGS. 4 through 8, the preferred embodiment of the pinch valve apparatus 50 of the present invention has a pie or wedge shaped horizontal, planar configuration making it suitable for use on the rotary embodiment of the pharmaceutical filler apparatus 20 such that a plurality of the pinch valve apparatus 50 may be arranged generally in a horizontal plane in a generally circular configuration while requiring a minimum of space. The pinch valve apparatus 50 is securedly attached at 70 by a bolt or the like to a flange-like structure 72 of the pharmaceutical filler apparatus 20, which is rotational therewith. The pinch valve apparatus 50 is mounted such that the wide end portion is directed generally radially outward from the vertical axis 31 of the rotary pharmaceutical apparatus 20. In the preferred embodiment, the pinch valve apparatus 50 includes a stationary member 74 and first and second pivotal members 76, 78. The first pivotal member 76 is pivotally interconnected to the stationary member 74 at 80 for pivotal motion about a substantially vertical axis, the stationary member 74 being bifurcated near its outer end proximate 80. The second pivotal member 78 is pivotally interconnected to the stationary member 74 at 82 for pivotal motion about a substantially horizontal axis.

The first pivotal member 76, is bent generally at 80 to form a first portion 84 extending generally in a radial direction toward the pharmaceutical filler apparatus 20 and a second portion 86 extending generally in a tangential direction of the pharmaceutical apparatus 20. The first portion 84 defines an edge portion 88 which cooperates with an edge portion 90 of the stationary member 74 to pinch shut the elastic portion 52 of the pharmaceutical delivery conduit 36 when the pinch valve apparatus 50 is in the closed position. Furthermore, 88 and 90 are radiused or tapered near the top and bottom thereof and are substantially parallel to each other when the pinch valve apparatus 50 is closed so as to assure a tight seal. Additionally, in the preferred embodiment, the spacing between the edges 88, 90 when the pinch valve apparatus 50 is in the closed position, is approximately twice the wall thickness of the elastic portion 52.

The second portion 86 of the first pivotal member 76 includes a contact head 92 near an end opposite pivot point 80 for cooperating with a contact pad 94 near an outer end of the second pivotal member 78 so as to retain the pinch valve apparatus 50 in the opened position. (Note that in FIGS. 4–6, the pinch valve apparatus 50 is shown in the closed position.) In the preferred embodiment, the top contact pad 92, 94 are triangular shape and are replaceable so as to enable rotation of the pads or complete replacement after extended use. Preferably the surface of the pads 92, 94 are made from a very resistant material such as hardened carbide. Furthermore in the embodiment shown, the contact pad 94 is yet another pad 95 so as to provide a two position catch which is useful during test and installation and cleaning.

The second pivotal member 78 extends generally radially outward from the pharmaceutical filler apparatus 20, diverging slightly from the stationary member 74 to form a V-shape configuration, the outer ends of which are spanned by the second portion 86 of the first pivotal member 76. The outer end of the second pivotal member 78, as illustrated in FIG. 6, is biased in a generally perpendicular direction toward the first pivotal member 76 by coil springs 96 such that edges of the triangular contact pads 92, 94 will engage each other when the end of the second portion 86 of the first pivotal member 76 is forced generally radially inward.

Figure 4:
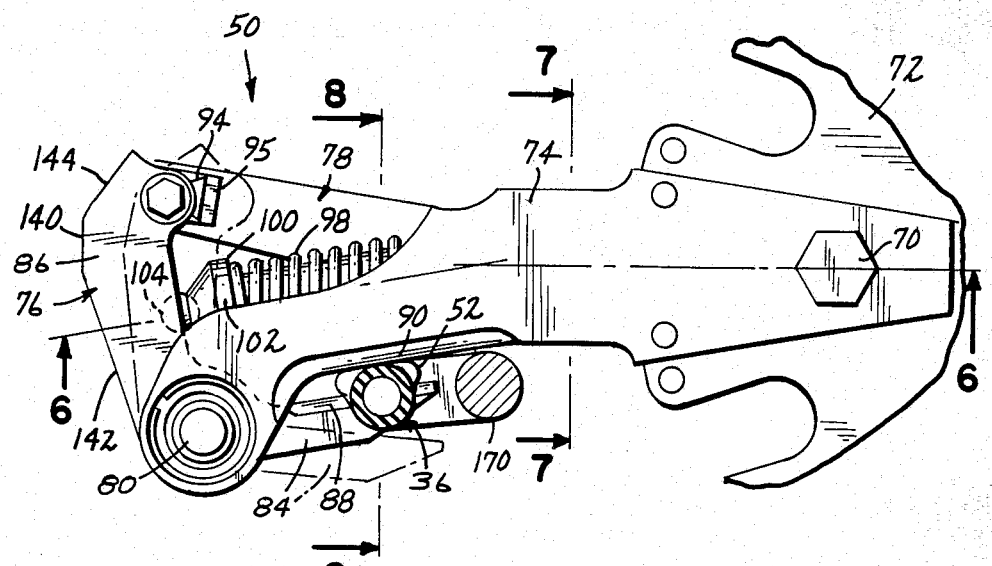
FIG. 4 is a top plan view as seen generally along line 4—4 in FIG. 3 of a preferred embodiment of a pinch valve apparatus emboding the principles of the present invention, the valve apparatus being in the closed position pinching shut an elastic portion of a pharmaceutical delivery conduit.
Figure 5:
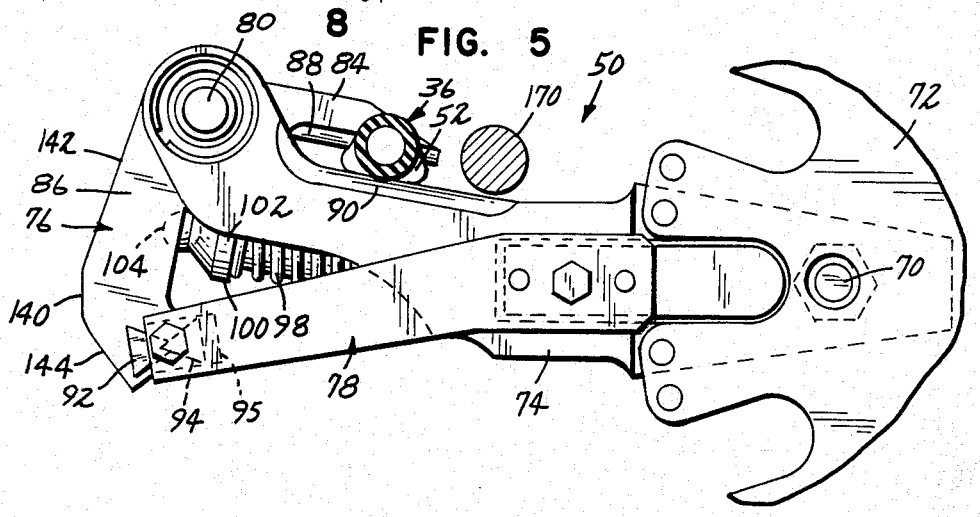
FIG. 5 is a bottom plan view of the pinch valve apparatus shown in FIG. 4.
Figure 6:
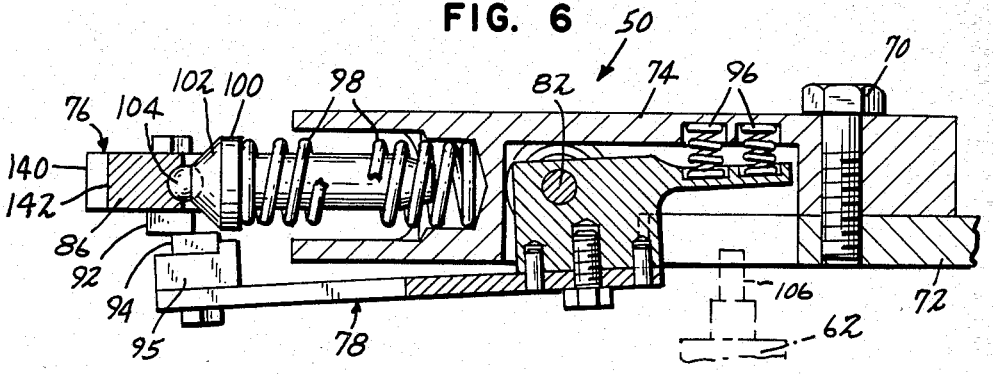
FIG. 6 is a view in vertical section as seen generally along lines 6—6 in FIG. 4.

As further illustrated in FIGS. 4 through 6, the pinch valve apparatus 50 includes a coil spring 98 and plunger 100 which cooperate to force the second portion 86 of the first pivotal member 76 generally radially outward. Accordingly, the pinch valve apparatus 50 is continuously being biased into the closed position. The spring and plunger combination extend in a generally radial direction with the inner end of the spring 98 retained in a cavity of the stationary member 74 and a head portion 102 of the plunger 100 being pivotally connected by a ball and socket connection 104 to the inside edge of the second portion 86 of the first pivotal member 76.

The coil spring 98 provides more bias than the coil springs 96 such that substantially more force is required to move the pinch valve apparatus 50 into the opened position than to release the pinch valve apparatus 50 by moving the contact pads 92, 94 apart whereby the pinch valve apparatus 50 moves into the closed position. This provides for a quick closing action and further provides the pinch valve apparatus 50 with a relatively fine trigger mechanism enabling quick and easy release of the pinch valve apparatus 50 when in the open position. In the preferred embodiment, this is accomplished by the solenoid 62 which as illustrated in FIG. 6, upon being activated by the timing system extends a piston portion 106 thereby forcing upward on the inner end of the second pivotal member 78 which overcomes the biasing effect of the coil spring 96 so as to move the contact pads 92, 94 apart and enable the coil spring 98 to quickly move the pinch valve apparatus 50 into the closed position. Due to the fine trigger mechanism, the solenoid 62 requires very little power in order to overcome the springs 96.

In the rotary pharmaceutical filler apparatus 20, there is one solenoid associated with each of the pinch valve apparatus 50. As illustrated in FIGS. 4 through 6 the flange portion 72 is cut away to allow for the solenoid 62 to be mounted directly below the inner ends of the second pivotal member 78. The solenoids 62, the pinch valve apparatus 50, the pharmaceutical delivery conduits 36, and the pharmaceutical containers are therefore all mounted on the pharmaceutical filler apparatus to revolve together about the vertical rotation axis 31 thereof.

As previously indicated each of the pinch valve apparatus 50 is positioned in the opened position by cam actuator apparatus 54. As illustrated in FIGS. 11 and 12 the cam actuator 54 includes a cylindrical disc 110 which is mounted onto a shaft 112 by set screw 114. The shaft 112 is operatively interconnected to a continuously rotating shaft 116 by a conventional clutch apparatus 118. Upon activation of the clutch apparatus 118 the shaft 112 and accordingly disc 110 are caused to rotate. Mounted below the disc 110 onto a stationary housing 120 surrounding the shaft 112 by a clamp apparatus 121 is a radially extending stationary bracket 122. Pivotal mounted to the end of the bracket at 124, is an elongated member 126 having two cylindrical rotary elements 128 and 130 pivotal attached thereto. The rotary element 128, as illustrated in FIG. 12, follows a rectangularly shaped groove 132 in the cylindrical disc 110 while the rotary element 130 is positioned below the cylindrical disc 110. The elongated member 126 is bent approximate the roller element 128. As illustrated in FIG. 11, the groove 132 is configured to be somewhat elliptical at two locations 132*a, b* so as to extend radially outward from the vertical axis of rotation, the locations 132*a, b* being spaced 180 degrees apart.

In operation, when the timing system determines the cam actuator apparatus 54 should be activated, the clutch apparatus 118 is activated to engage the rotating shaft 116 whereby the cylindrical disc 110 is made to rotate. As the disc 110 rotates, the roller element 128 follows the rectangular groove 132. Upon reaching the areas 132*a, b*, the roller element 128 is caused to move generally radially outward whereby the roller element 130 is caused to also move generally radially outward and engage an outer edge portion 140 of the second portion 86 of the first pivotal member 76 of the pinch valve apparatus 50. The second portion 86 of the first pivotal member 76 is thus caused to move generally radially inward toward the vertical axis 31 of the pharmaceutical apparatus 20 a sufficent distance such that the edges of the contact pads 92, 94 engage each other and retain the pinch valve apparatus 50 in the open position so that pharmaceutical begins flowing into the associated pharmaceutical container.

As illustrated in FIG. 5, the second portion 86 of the first pivotal member has two outer edge portions 142, 144 which obliquely intersect the outer edge portion 140. The orientation of the surfaces 142, 144 assist in assuring that the cam actuator apparatus 54 will not engage the pinch valve apparatus 50 at an improper time and for no longer of a time period than necessary. For example, the edge portion 144 assures that the pinch valve apparatus 50 will not be engaged by the roller element 130 prematurely while the edge portion 142 assures that the roller element 130 will engage the pinch valve apparatus 50 for only a brief period of time. Furthermore, the cam actuator 54 is configured such that the roller element 130 approaches the edge portion 140 substantially tangentially thereto so as to be positioned adjacent the edge portion 140 prior to activation of the pinch valve assembly. Also as illustrated in FIG. 11, the edge portion 140 is positioned generally on the circumference of the rotary pharmaceutical filler apparatus 20 as illustrated by a line 146. Accordingly, jarring and wear of the pharmaceutical apparatus 20 during the opening process is reduced. Furthermore, the roller element 130 exerts a force generally opposite that of the coil spring 98 so as to minimize the force required in order to overcome the bias effect of the coil spring 98.

Since the rectangular shaped groove 132 in the preferred embodiment illustrated, has two of the elliptical portions 132*a, b*, the clutch apparatus 118 need only engage the rotating shaft for one-half of a complete rotation or 180 degrees. This facilitates rapid operational speed although it will be appreciated that one or more elliptical portions might be utilized.

As illustrated in FIG. 12, the sensor 60 which preferably is of a contactless type such an electro-magnetic sensor, is suitably mounted to a housing 152 by a mounting assembly 154 for detecting movement of the cylindrical disc 110. The sensor 60 detects the presents of two metal projections 156 attached to a disc 158 which rotates in unison with the disc 110. The projections 156 are positioned on a disc 158 such that they pass generally adjacent sensor 60 when the pinch valve apparatus 50 is opened by the cam actuator apparatus 54. The sensor 60, which is electrically connected by suitable connectors 160 to the electronic timing system, provides a signal to the electronic timing system upon the detection of the projection 156 which informs the timing system that the pinch valve apparatus 50 has been opened. The timing system (as previously described) monitors the time and informs the associated solenoid 62 when the pinch valve apparatus 50 is to be closed.

An important feature of the present invention is that the pinch valve apparatus 50, the cam actuator apparatus 54, and the solenoid 62 need not be sterilized when dispensing and metering pharmaceutical as these elements do not come in contact with the pharmaceutical. This reduces the amount of overhead maintenance required. Furthermore, the mechanical pinch valve apparatus 50, cam actuator 54, and electrical solenoid 62 provide for a very quick acting, accurate system which is repeatable. Hydraulic valves or the like, frequently utilized in pharmaceutical dispensing and metering, require a period of time to operate and often provide variable results when operated at speeds approaching their minimum reactance times.

As illustrated in FIGS. 9 and 10, the nozzle portion 34 of each of the pharmaceutical delivery conduits 36 includes a fixed orifice 35. The nozzle portion 34 is substantially rigid and is attached to the end of the elastic portion 52 for partial insertion into the associated pharmaceutical container. Due to the relatively high speed at which the pharmaceutical apparatus 20 rotates, the nozzle portion 34 in addition to providing discharge of the pharmaceutical, also assists in retaining the pharmaceutical containers on the stations 30. In the present invention, the orifice 35 is substantially closer to the discharge point at the end of the nozzle 34 than the top or beginning of the pharmaceutical conduit 36 and the manifold 38. Furthermore, the inside diameter of the orifice 35 is much smaller than the inside diameter of the nozzle 34 or the pharmaceutical delivery conduit 36. This minimizes friction between the inside walls and the pharmaceutical as it flows in the pharmaceutical delivery conduit 36, thereby reducing turbulence and resulting in a much more even flow of a predetermined quantity. In the embodiment illustrated in FIGS. 9 and 10 the nozzle 34 has an inside diameter (0.125 inches in the preferred embodiment shown) approximately twice as large as the orifice 35 (0.067 inches in the embodiment shown). It will be appreciated that the nozzle 34 and the orifice 35 might have other specific inside diameters in keeping with the principles of the present invention. The nozzle 34 is illustrated as including a flange 166 for limiting the distance of insertion into the elastic portion 52 of the pharmaceutical delivery conduit 36 and includes serrations 168 for retaining the elastic portion 52 on the nozzle 34.

The nozzles 34 are held in position as illustrated in FIG. 3, by a bracket 170 which extends vertically downward from a relatively flat ring-like support plate 171 which in turn is mounted to a rotating portion 174 of the rotary pharmaceutical filler apparatus 20 by a bracket 173. As further illustrated in FIG. 1 the support plate 171 is vertically adjustable by any one of four adjustment screws 176 suitably connected by a chain 178 to one another. A plate 172 is attached to the plate 171 by releasable fastener screws 180, there being four sets of two screws each to enable the removal of a quarter section of the plate 172 by releasing two of the fasteners 180. The plate 171 defines slightly larger aperatures than the plate 172 for passage therethrough of the pharmaceutical delivery conduits 36 and their associated nozzles 34. Accordingly, the pharmaceutical delivery conduits 36 and their associated nozzles 34 may be readily removed from the brackets 170 or the manifold 38 by removing the plate 172. This facilitates removal of the conduits 36 for cleaning or interchanging of the nozzle portions 34.

The elastic portions 52 of the pharmaceutical delivery conduits 36 are interconnected at their top ends to nozzles 182 positioned in plates 184 which are attached to the rotating manifold 38. The manifold plates 184 are attached in quarter sections to the manifold 38 by releasable fasteners 186 similar to the fasteners 180. The manifold 38 includes a plurality of pathways 188 connecting the elastic portions 52 to the conduit 40 which extends vertically upward to the reservoir 42.

The rotating portion 174 is interconnected to a lower rotating shaft 190 which in turn is driven by a conventional drive mechanism (not shown). The lower shaft 190 is enclosed by a nonrotating housing portion 192 which is securely attached to a mounting base 193. The pharmaceutical filler apparatus 20 is interconnected to the housing portion 192 by a suitable bearing structure 191 such that the pharmaceutical filler apparatus is rotatably supported by the housing portion 192 above the mounting base 193. The solenoids 62 are preferably enclosed within a housing portion 194 which rotates with the rotating portion 174. The electrical connections (not shown) for the solenoids 62 are preferably fed up through a space 195 hollow lower shaft 190 and into the housing 194 for connection to the solenoids 62.

Also enclosed within a housing portion 196 are the lift apparatus 32 which in the preferred embodiment include a cam follower 198 associated with each of the stations 30 and biased radially outward by a spring mechanism 200 for following a track 201 in a stationary cylindrical wall 202 about the circumference of the pharmaceutical apparatus 20. The cam follower 198 is interconnected to a platform 204 at the pharmaceutical container station 30 which supports the pharmaceutical containers 25, by a shaft 206. The track 201 varies in height such that as the cam follower member 198 revolves, its elevation changes thereby raising and lowering the platform 204 on which the pharmaceutical container is supported as required for filling purposes. The lift apparatus 32 includes a pair of rods 203 providing a vertical guide for the movement of the lift apparatus 32. The spring detent mechanism 200 minimizes spillage or breakage of the pharmaceutical containers by allowing the cam follower 198 to slip out of the track 201 if the nozzle 34 should hit a pharmaceutical container and encounter some other obstruction.

As previously indicated, the preferred embodiment of the present invention utilizes the reservoir 42 positioned above the manifold 38 for providing pharmaceutical at a predetermined pressure to the pharmaceutical delivery conduits 36. The reservoir 42 has substantially more volume than the pharmaceutical delivery conduits 36 combined such that as pharmaceutical is delivered to the containers there is a slight drop in the pharmaceutical level inside the reservoir 42. The level of pharmaceutical is monitored by a capacitance type sensor 220 whose probe 22 is preferably inserted into the reservoir 42 at an angle as generally illustrated in FIG. 1 so as to be more sensitive to changes in level. The sensor 220 provides via electrical connectors 218 a signal corresponding to the level of the pharmaceutical which is fed to a transducer (not shown) which converts the electrical signal into air pressure. The corresponding air pressure is supplied to a valve actuator apparatus 224 air supply lines (not shown) in the column 230, which controls a servo valve 226 to provide for controlled input of a pharmaceutical through a delivery conduit 228. Due to the relatively large volume of the reservoir 42 the level of the pharmaceutical will change gradually enabling accurate control of the pressure in the pharmaceutical delivery conduits 36 and preventing the valve actuator 224 from being switch on and off in rapid succession due to rapidly fluctuating fluid levels. The level control system comprises commercially available items; for example, the sensor is a DELAVAN Capacitance Probe System, the transducer is a MOORE E/P Transducer, and the air valve is a LADISH Valve with Moore Positioner. It will be appreciated that other level control systems in keeping with the principles of the present invention might be utilized.

The top cover portion 240 of the reservoir 42 is connected to the reservoir 42 by a clamp fitting apparatus 242 which enables the cover to remain stationary while the reservor 42 rotates with the rotary portions of the pharmaceutical filler apparatus 20. In use, the cover portion is slightly elevated, however, when cleaning the pharmaceutical filler apparatus 20, the cover portion 240 is clamped tightly onto the reservoir 42 so that the system can be thorough flushed.

An alternate embodiment of the present invention is illustrated in FIGS. 13 and 14, wherein the solenoid 62 are mounted on a stationary bracket 250 extending approximately 180 degrees about the pharmaceutical apparatus 20. The plunger portion 106 of the solenoid extends radially inwardly above the member 78 and vertically downward to engage the outer end of the second pivotal member 78 which has been extended in length as to extend beyond the first pivotal member 76 and widened near the outer end. It will be appreciated while reducing the number of solenoid 22 required and correspondingly the mass which must be rotated, this embodiment does require more overhead for control purposes in order to determine which of the solenoid 62 will deactivate or close the respective pinch valve apparatus 50. This is due to the fact there is no longer one of the solenoid 62 associated with each of the pinch valve apparatus 50 so the position of the pinch valve apparatus 50 must be monitored.

It will be further appreciated, that while the pharmaceutical filler apparatus 20 has been described as being a rotary structure configured for rotation above the vertical axis offset from the conveyor, the pharmaceutical apparatus 20 might also be utilized in a linear arrangement adjacent the conveyor.

Furthermore, while it is preferred that the reservoir 42 and its associated level control system be utilized as the method for maintaining constant pressure, various pump system might be utilized in conjunction with the pinch valve apparatus 50 of the present invention.

As previously mentioned, the present invention provides a pharmaceutical apparatus which is quick, accurate, and repeatable. This is accomplished by controlling the parameters of time, pressure and orifice opening. Furthermore, the present invention is easy to clean as it reduces the number of parts which must be cleaned and provides for quick disassembly of those parts to which access must be had for cleaning purposes. In addition, the present invention reduces the amount of wear and correspondingly the amount of particulate created and introduced into the pharmaceutical delivery conduits. As a result of its configuration, the present invention is relatively inexpensive and easy to maintain, having relatively few complicated parts.

The pinch valve apparatus of the present invention provides a two position which lends itself to control by digital electronic timing systems. Furthermore, the pinch valve apparatus does not come in intimate contact with or contaminate the pharmaceuticals. In addition, the pinch valve apparatus is quick acting and provides repeatability of performance. In conjunction with the cam actuator apparatus, the pinch valve apparatus can be substantially instantaneously positioned in the opened position. When utilized with an elastic portion of the fluid delivery conduit which has good memory characteristics, this effectively assures a two position valve, either fully opened or fully closed.

In addition, the present invention is configured to reduce the amount of turbulence or unpredictable pharmaceutical flow in the pharmaceutical delivery conduit due to the size and positioning of the orifice in the pharmaceutical delivery conduit 36 which is also preferably an interchangable fixed orifice.

It should be understood, however, that even though numerous characteristics and advantages of the invention have been set forth in the foregoing description, together with details of the structure and function of the invention, the disclosure is illustrative only, and changes may be made in detail, especially in matters of shape, size and arrangement of parts within the principal of the invention to the full extent indicated by the broad general meaning of the terms in which the appended claims are expressed.

What is claimed is:

1. A fluid dispensing and metering assembly comprising:

(a) a conveyor for conveying containers, first detection means for detecting movement of said conveyor past a first predetermined location;

(b) positioning means cooperating with said conveyor for positioning each of said containers proximate a fluid delivery conduit for receipt of fluid from said fluid delivery conduit;

(c) a reservor of fluid positioned above said containers at a predetermined height, said reservoir including means for maintaining a constant fluid level in said reservoir, said fluid delivery conduit being interconnected to said reservoir to provide a fluid flow path from said reservoir to said container positioned for receipt of fluid from said fluid delivery conduit; said fluid delivery conduit including a fixed orifice of substantially less diameter than the inside diameter of said fluid delivery conduit, said fixed orifice being positioned closer to the point of fluid discharge into the container than to said fluid reservoir;

(d) quick acting pinch valve means associated with said fluid delivery conduit for opening and closing said fluid delivery conduit, said pinch valve means having first and second positions, said valve means interacting with an elastic portion of said fluid delivery conduit, said elastic portion of said fluid delivery conduit being pinched shut by said valve means when said valve means is in said first position, said elastic portion of said fluid delivery conduit being fully opened when said valve means is in said second position, said valve means including biasing means for biasing said valve means towards the first position and further including releasable retention means for retaining said valve means in said second position, said valve means returning substantially simultaneously to said first position upon release by said retention means, said valve means including a first pivotal member having first and second ends, said first pivotal member being pivotal about a generally vertical axis positioned between said first and second ends, a spring means being interconnected to said first pivotal member for biasing said first pivotal member into a first position, an edge portion of said first pivotal member between said first end and said vertical pivot axis cooperating with a stationary member to pinch shut said elastic portion of said fluid delivery conduit when in said first position, said retention means including said first pivotal member cooperating with a second pivotal member to retain said first pivotal member in said second position, said second pivotal member being pivotal about a generally horizontal axis, said second pivotal member further being biased by biasing means in a vertical direction towards said first pivotal member;

(e) cam actuator means positioned downstream from said first detection means for positioning said valve means in said second position;

(f) first timing means for monitoring movement of said containers after being detected by said first detection means, said first timing means activating said cam actuator means when one of said containers and its associated valve means are suitably positioned adjacent said cam actuator means, said cam actuator means positioning said valve means in said second position upon being activated by said first timing means;

(g) second detection means for detecting the positioning of said valve means in said second position;

(h) second timing means for monitoring the amount of fluid delivered into said containers;

(i) release means activated by said second timing means for releasing said retention means; and (j) said positioning means including a rotary apparatus rotating about a vertical axis offset from said conveyor, said rotary apparatus including a plurality of stations each adapted for receipt of one of said containers, each of said containers including one of said delivery conduits, one of said pinch valves, and one of said release means operatively interconnected to dispense and meter a predetermined amount of fluid into said associated container.

2. A fluid metering apparatus in accordance with claim 1, wherein at least one of said first and second pivotal members includes replaceable contact pads for engaging the other pivotal member.

3. A fluid metering apparatus in accordance with claim 2, wherein said release means includes a solenoid for importing a vertical force on said second pivotal member opposite in direction to the force exerted by said biasing means.

4. A fluid metering apparatus, in accordance with claim 3, wherein the edge portion of said first pivotal member between said first end and said vertical pivotal axis is generally parallel to the stationary member when in said first position.

5. A fluid metering apparatus in accordance with claim 4, wherein the spacing between said stationary member and the edge portion of said first pivotal member between the first end and said vertical pivot axis is approximately twice the wall thickness of the elastic portion of the fluid delivery conduit when said pinch valve means is in said first position.

6. A fluid metering apparatus in accordance with claim 2, wherein said first and second pivotal members each include replaceable, triangularly shaped contact pads.

7. A fluid metering apparatus in accordance with claim 1, wherein said fluid reservoir includes a fluid level sensor to monitor fluid level in said fluid reservoir, said fluid sensor providing input to control means, said control means causing fluid to be delivered to said reservoir as required to maintain a predetermined level of fluid.

8. A fluid metering apparatus in accordance with claim 1, wherein said cam actuator means includes a disc member operatively interconnected to a rotating shaft by a clutch mechanism, said disc member having a groove defined therein, said cam actuator means further including a cam follower member, said groove being configured to cause said cam follower member to engage said pinch valve means and force said pinch valve means into said second position upon rotation of said disc member a predetermined amount.

9. A fluid dispensing and metering assembly comprising:

a conveyor for conveying containers along a path of travel in a downstream direction, first detection means for detecting movement of said containers past a first predetermined location;

positioning means cooperating with said conveyor for positioning each of said containers proximate a fluid delivery conduit for receipt of fluid from said fluid delivery conduit; said fluid delivery conduit being positioned proximate its associated container along a predetermined portion of the path of travel of the container so as to have a path of travel corresponding to that portion of the path of travel of the container;

a reservoir of fluid positioned above said containers at a predetermined height, said reservoir including means for maintaining a constant fluid level in said reservoir, said fluid delivery conduit being interconnected to said reservoir to provide a fluid flow path from said reservoir to said container positioned for receipt of fluid from said fluid delivery conduit;

said fluid delivery conduit including a fixed orifice of substantially less diameter than the inside diameter of said fluid delivery conduit, said fixed orifice being positioned closer to the point of fluid discharge into the container than to said fluid reservoir;

quick acting pinch valve means associated with and having a path of travel corresponding to said fluid delivery conduit for opening and closing said fluid delivery conduit, said pinch valve means having first and second positions, said valve means interacting with an elastic portion of said fluid delivery conduit, said elastic portion of said fluid delivery conduit being pinched shut by said valve means when said valve means is in said first position, said elastic portion of said fluid delivery conduit being fully opened when said valve means is in said second position, said valve means including biasing means for biasing said valve means toward said first position and further including releasable retention means traveling with said valve means for retaining said valve means in said second position, said valve means returning substantially simultaneously to said first position upon release by said retention means;

cam actuator means positioned downstream from said first detection means for positioning said valve means in said second position, said cam actuator means being movable between a first location partially in the path of travel of said valve means and a second location out of the path of travel of said valve means;

first timing means for monitoring movement of said containers after being detected by said first detection means, said first timing means activating said cam actuator means when one of said containers and its associated valve means are suitably positioned adjacent said cam actuator means, said cam actuator means moving into said first location to engage said valve means and force said valve means into said second position upon being activated by said first timing means, said cam actuator means including means for moving said cam actuator means away from the first location and out of engagement with said valve means before the container associated with said valve means is sufficiently filled;

second detection means for detecting the positioning of said valve means in said second position;

second electronic timing means electrically interconnected to said second detection means for monitoring the amount of fluid delivered into said container; and release means activated by said second timing means for releasing said retention means.

10. A fluid metering apparatus in accordance with claim 9, wherein said valve means includes a first pivotal member having first and second ends, said first pivotal member being pivotal about a generally vertical axis positioned between said first and second ends, a spring means being interconnected to said first pivotal member for biasing said first pivotal member into a first position, an edge portion of said first pivotal member between said first end and said vertical pivot axis cooperating with a stationary member to pinch shut said elastic portion of said fluid delivery conduit when in said first position.

11. A fluid metering apparatus in accordance with claim 10, wherein said first pivotal member cooperates with a second pivotal member to retain said first pivotal member in said second position, said second pivotal member being pivotal about a generally horizontal axis, said second pivotal member further being biased by biasing means in a vertical direction towards said first pivotal member.

12. A fluid metering apparatus in accordance with claim 9, wherein said positioning means includes a rotary apparatus rotating about a vertical axis offset from said conveyor, said rotary apparatus including a plurality of stations each adapted for receipt of one of said containers, each of said stations including one of said delivery conduits, one of said pinch valves, and one of said release means operatively interconnected to dispense and meter a predetermined amount of fluid into said associated container.

13. A valve apparatus used in conjunction with an elastomeric portion of a fluid delivery conduit in fluid dispensing and metering comprising:

(a) a stationary member;

(b) a first pivotal member pivotally connected to the stationary member for pivotal movement about a substantially vertical axis, said first pivotal member having first and second ends, said first pivotal member further being pivoted between first and second positions;

(c) spring biasing means interconnected to said first pivotal member for biasing said first pivotal member into said first position, said first pivotal member pinching shut the elastomeric portion of the fluid delivery conduit when in said first position;

(d) mechanical cam means cooperating with said first pivotal member for positioning said first pivotal member in said second position, the elastomeric portion of the fluid delivery conduit being open when said first pivotal member is in said second position;

(e) retention means for releasably retaining said first pivotal member in said second position, said retention means including a second pivotal member interconnected to said stationary member and pivotal about a substantially horizontal axis, said second pivotal member including first and second ends, said second pivotal member including biasing means for biasing the first end of said second pivotal member in a vertical direction toward said first pivotal member, the first end of said second pivotal member cooperating with said first pivotal member to releasably retain said first pivotal member in said second position, said release means engaging said second pivotal member to force the first end of said second pivotal member away from said first pivotal member whereby said first pivotal member is released and moved by said spring biasing means into said first position; and (f) release means for releasing said retention means, said spring biasing means substantially instantaneously forcing said first pivotal member into said first position upon release by said retention means, whereby the valve apparatus effectively has two positions, either opened or closed.

14. A valve apparatus in accordance with claim 13, wherein an edge portion of said first pivotal member between the first end and the vertical pivot axis is substantially parallel to a second edge when in said first position.

15. A valve apparatus in accordance with claim 13, wherein said spring biasing means includes a coil spring adapted to receive at least a portion of a plunger member, said plunger member being pivotally interconnected to the first pivotal member between the second end of said first pivotal member and said vertical pivot axis.

16. A valve apparatus in accordance with claim 13, wherein said first and second pivotal members include replacable contact pads, said replaceable contact pads cooperating with one another when said first pivotal member is in said second position to releasably retain said first pivotal member in said second position.

17. A fluid dispensing and metering apparatus, comprising:

(a) a housing rotatably supported by a support structure for rotational movement about a vertical axis;

(b) a plurality of stations positioned about the circumference of said housing for rotation therewith along a path of travel, each of said stations being configured for holding a fluid container, said stations being operatively interconnected to lift means for raising and lowering said stations;

(c) fluid source means including control means for maintaining the fluid at a predetermined pressure;

(d) a fluid delivery conduit being associated with each of said stations, said fluid delivery conduits being interconnected to said fluid source means to provide a fluid flow path from said fluid source means to said containers;

(e) each of said fluid delivery conduits having an orifice portion of less diameter than the inside diameter of the fluid delivery conduits;

(f) separate and distinct mechanical pinch valve means being associated with each of said fluid delivery conduits and having a path of travel corresponding to the path of travel of said stations for cooperating with an elastic portion of said fluid delivery conduits to open and close said fluid delivery conduits, said pinch valve means including means integral with said pinch valve means for biasing said pinch valve means into a closed position whereby said fluid delivery conduits are closed, said pinch valve means further including retention means integral with said pinch valve means for releasably retaining said pinch valve means in an opened position whereby said fluid delivery conduits are opened;

(g) cam actuator means positioned at a predetermined location along the path of travel of said stations for positioning said pinch valve means in said opened position, said cam actuator means including means for engaging said pinch valve means traveling past said predetermined location and disengaging said pinch valve means before their associated containers are filled with fluid;

(h) means for monitoring the amount of time said fluid delivery conduits are opened; and (i) release means operatively interconnected to said monitoring means for releasing said retention means, whereby upon release of said retention means said pinch valve means is biased into said closed position by said biasing means.

18. A valve apparatus used in conjunction with an elastomeric portion of a fluid delivery conduit in fluid dispensing and metering, comprising:

(a) a stationary member;

(b) a first pivotal member pivotally connected to the stationary member for pivotal movement about a substantially vertical axis, said first pivotal member having first and second ends, said first pivotal member further being pivoted between first and second positions;

(c) spring biasing means interconnected to said first pivotal member for biasing said first pivotal member into said first position, said first pivotal member pinching shut the elastomeric portion of said fluid delivery conduit when in said first position; and (d) retention means for releasably retaining said first pivotal member in said second position, said retention means including a second pivotal member pivotal about a substantially horizontal axis, said second pivotal member including first and second ends, said second pivotal member further including biasing means for biasing the first end of said second pivotal member in a vertical direction towards said first pivotal member, the first end of said second pivotal member cooperating with said first pivotal member to releasably retain said first pivotal member in said second position.

* * * * *

UNITED STATES PATENT AND TRADEMARK OFFICE

CERTIFICATE OF CORRECTION

PATENT NO. : 4,508,148

DATED : April 2, 1985

INVENTOR(S) : HANS W. TRECHSEL, et al.

It is certified that error appears in the above-identified patent and that said Letters Patent is hereby corrected as shown below:

Column 1, line 10, "pharmaceutical" should be --pharmaceutical

Column 1, line 50, "predetermine" should be --predetermined--;

Column 4, line 16, "advantageous" should be --advantage--;

Column 6, line 17, "detailed" should be --detail--;

Column 6, line 25, "describe" should be --described--;

Column 8, line 49, "pivotal" should be --pivotally--;

Column 9, line 46, "presents" should be --presence--;

Column 10, lines 51-52, "aperatures" should be --apertures--;

Column 11, line 62, "switch" should be --switched--;

Column 12, line 11, "thorough" should be --thoroughly--;

Column 12, line 40, "system" should be --systems--;

Column 12, line 57, after "position" insert --valve--;

Column 17, line 41, "replacable" (first occurence) should be --replaceable--.

Signed and Sealed this

*Tenth* Day of *June 1986*

[SEAL]

*Attest:*

DONALD J. QUIGG

*Attesting Officer* *Commissioner of Patents and Trademarks*